US007008356B2

(12) United States Patent
Hung

(10) Patent No.: US 7,008,356 B2
(45) Date of Patent: Mar. 7, 2006

(54) ABDOMINAL EXERCISING DEVICE WITH ROTATION BODY AND COUNTERWEIGHT

(76) Inventor: Ming-Hsueh Hung, 28, Lane 396, Sec. 2, Zhungyang Rd., Tucheng, Taipei Hsien (TW)

( * ) Notice: Subject to any disclaimer, the term of this patent is extended or adjusted under 35 U.S.C. 154(b) by 95 days.

(21) Appl. No.: 10/823,120

(22) Filed: Apr. 12, 2004

(65) Prior Publication Data

US 2005/0143232 A1 Jun. 30, 2005

(30) Foreign Application Priority Data

Dec. 31, 2003 (TW) ..... 92223123 U

(51) Int. Cl.
*A63B 26/00* (2006.01)
*A63B 21/22* (2006.01)
*A63B 21/05* (2006.01)

(52) U.S. Cl. ..... 482/140; 482/110; 482/128

(58) Field of Classification Search ..... 482/121, 482/122, 123, 127, 128, 93, 110, 62, 133, 482/139, 140; 446/238, 266
See application file for complete search history.

(56) References Cited

U.S. PATENT DOCUMENTS 5,651,755 A * 7/1997 Chen ..... 482/128
5,795,275 A * 8/1998 Van Der Hoeven et al. ..... 482/122
6,488,614 B1 * 12/2002 Chang ..... 482/110
6,616,582 B1 * 9/2003 Jiang ..... 482/140
6,719,675 B1 * 4/2004 Yu ..... 482/110

* cited by examiner

*Primary Examiner*—Stephen R. Crow
*Assistant Examiner*—Allana Lewin
(74) *Attorney, Agent, or Firm*—Alan D. Kamrath; Nikolai & Mersereau, P.A.

(57) ABSTRACT

An exercising device includes a main body, two handles, a support rod, a resting board, a connecting lever, and a rotation body. The main body includes two casings, a slide, and an elastic member. The rotation body includes a pivot ring secured on the connecting lever, a first disk rotatably mounted on the pivot ring, a second disk rotatably mounted on the pivot ring and combined with the first disk so that the pivot ring is located between the first disk and the second disk, and a counterweight mounted between the first disk and the second disk to rotate therewith. Thus, the exercising device is used to exercise a user's arms, waist and abdomen simultaneously.

20 Claims, 10 Drawing Sheets

ABDOMINAL EXERCISING DEVICE WITH ROTATION BODY AND COUNTERWEIGHT

BACKGROUND OF THE INVENTION

1. Field of the Invention

The present invention relates to an exercising device, and more particularly to an exercising device that can be used to exercise the muscles of a user's arms, waist and abdomen simultaneously, thereby greatly increasing the versatility of the exercising device.

2. Description of the Related Art

A conventional exercising device has a complicated construction with a large volume, so that it occupies larger space and cannot be stored and transported easily and conveniently. In addition, the conventional exercising machine cannot be used conveniently due to its larger bulk. Further, the conventional exercising device has a single function to exercise the muscles of the user's arms, chest, waist or abdomen only, thereby limiting the versatility of the conventional exercising device.

SUMMARY OF THE INVENTION

The primary objective of the present invention is to provide an exercising device that can be used to exercise the muscles of a user's arms, waist and abdomen simultaneously, thereby greatly increasing the versatility of the exercising device.

Another objective of the present invention is to provide an exercising device, wherein the limit member is unscrewed from the respective casing to detach from the limit channel of the support rod, so that the support rod can be detached from the main body easily and rapidly, there facilitating storage, package and transportation of the exercising device.

A further objective of the present invention is to provide an exercising device, wherein the counterweight of the rotation body is movable in the rotation body by unscrewing the threaded rod to adjust the relative position of the counterweight in the rotation body, so as to adjust the resistance of the counterweight to rotation of the rotation body.

A further objective of the present invention is to provide an exercising device, wherein the generator produces an electric current which is supplied to the sound emitter to produce sound and to the light emitting diodes to produce light, thereby enhancing the versatility of the exercising device.

In accordance with the present invention, there is provided an exercising device, comprising a main body, two handles, a support rod, a resting board, a connecting lever, and a rotation body, wherein:

the main body includes two casings, a slide, and an elastic member;

each of the two casings of the main body has an inside formed with an axially extended slide channel;

the slide of the main body is mounted between the two casings and movably mounted in the slide channel of each of the two casings;

the elastic member of the main body is mounted between the two casings and received in the slide channel of each of the two casings, the elastic member of the main body has a first end urged on the slide and a second end urged on the two casings;

each of the two handles is mounted on the main body;

the support rod is movably mounted in the slide channel of the main body and has a first end secured on the slide of the main body;

the resting board is mounted on the support rod;

the connecting lever is mounted on the main body; and the rotation body includes a pivot ring secured on the connecting lever, a first disk rotatably mounted on the pivot ring, a second disk rotatably mounted on the pivot ring and combined with the first disk so that the pivot ring is located between the first disk and the second disk, and a counterweight mounted between the first disk and the second disk to rotate therewith.

Further benefits and advantages of the present invention will become apparent after a careful reading of the detailed description with appropriate reference to the accompanying drawings.

DETAILED DESCRIPTION OF THE INVENTION

Figure 1:
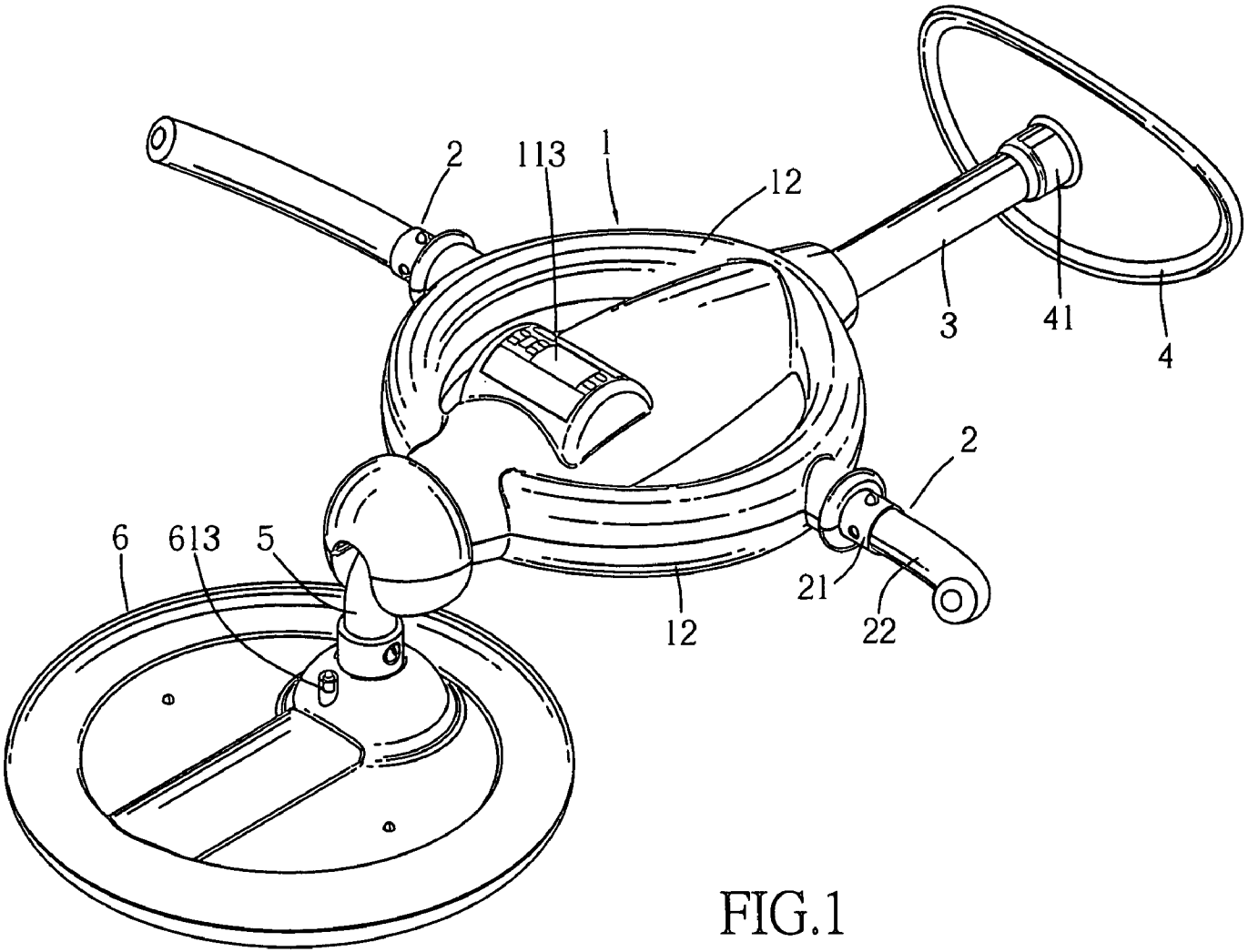
FIG. 1 is a perspective view of an exercising device in accordance with the preferred embodiment of the present invention.
Figure 2:
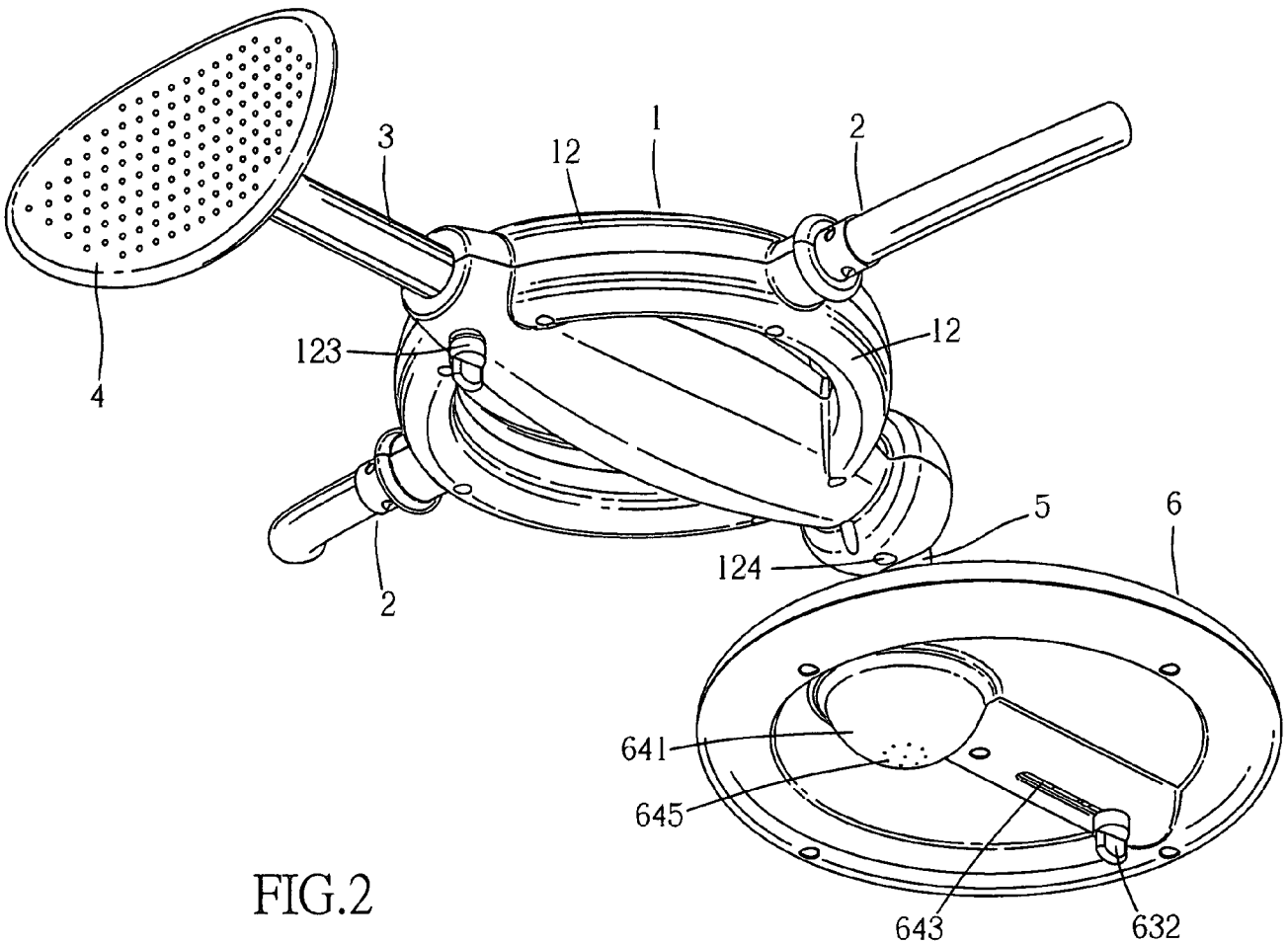
FIG. 2 is a perspective view of the exercising device in accordance with the preferred embodiment of the present invention.
Figure 3:
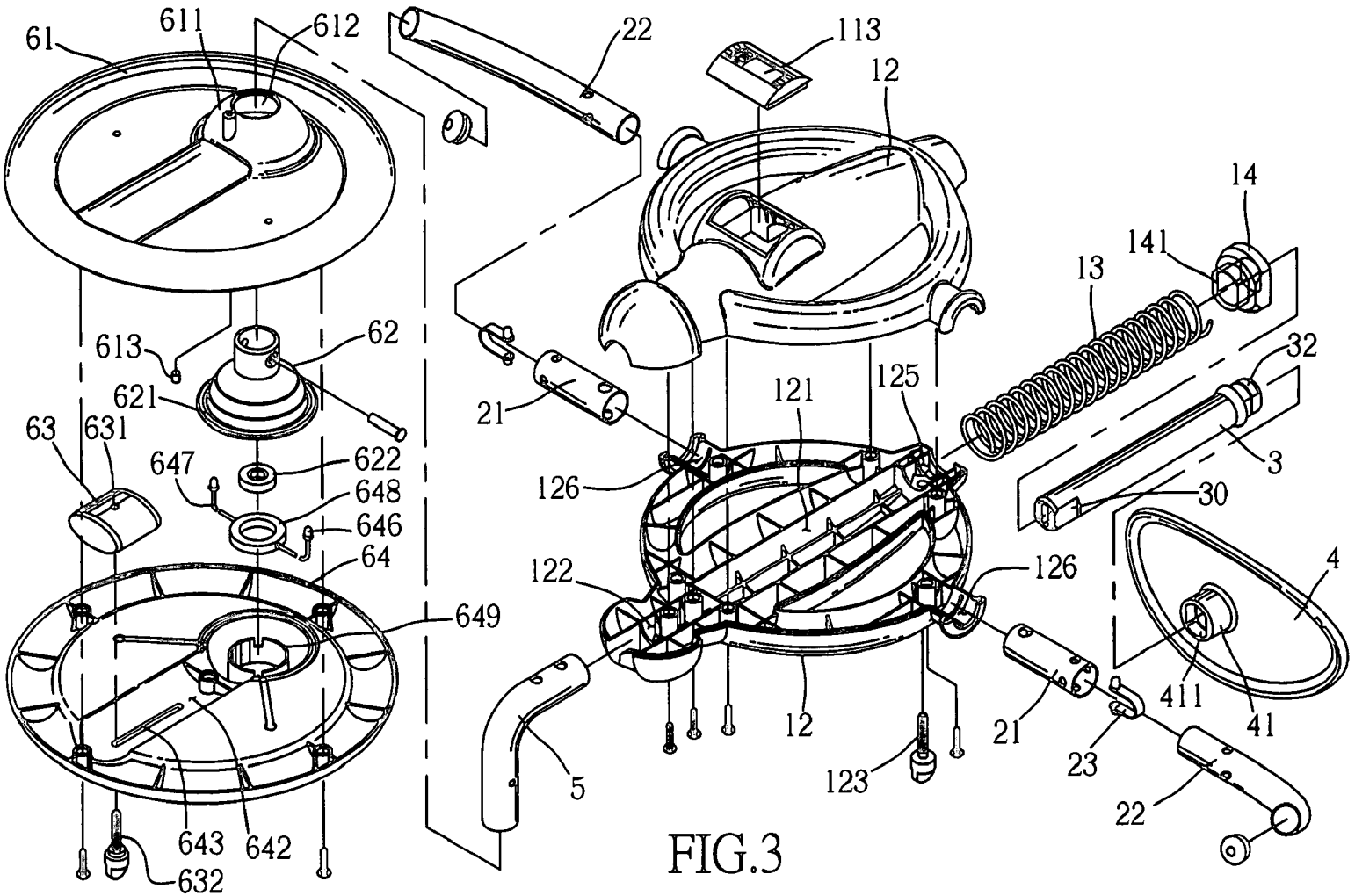
FIG. 3 is an exploded perspective view of the exercising device in accordance with the preferred embodiment of the present invention.

Referring to the drawings and initially to FIGS. 1–7, an exercising device in accordance with the preferred embodiment of the present invention comprises a main body 1, two handles 2, a support rod 3, a resting board 4, a connecting lever 5, and a rotation body 6.

The main body 1 includes two circular casings 12, a slide 14, and an elastic member 13.

The two casings 12 of the main body 1 are combined with each other. Each of the two casings 12 of the main body 1 has an inside formed with an axially extended slide channel 121. An electronic counter 113 is mounted on one of the two casings 12 of the main body 1 and located adjacent to the slide channel 121. The slide channel 121 of each of the two casings 12 has a first end formed with a first receiving recess 125 and a second end formed with a second receiving recess 122. A sensing counter 124 (see FIG. 5) is mounted on the other one of the two casings 12 of the main body 1 and located adjacent to the second receiving recess 122. Each of the two casings 12 of the main body 1 has a periphery formed with two opposite mounting recesses 126.

The slide 14 of the main body 1 is mounted between the two casings 12 and movably mounted in the slide channel 121 of each of the two casings 12.

The elastic member 13 of the main body 1 is mounted between the two casings 12 and received in the slide channel 121 of each of the two casings 12. The elastic member 13 of the main body 1 has a first end urged on the slide 14 and a second end urged on the two casings 12.

Each of the two handles 2 is mounted on the main body 1 and includes a mounting section 21 inserted into and locked in a respective one of the two mounting recesses 126 of each of the two casings 12, and an operation section 22 adjustably mounted on the mounting section 21 by an elastic snapping member 23.

The support rod 3 is movably mounted in the slide channel 121 of the main body 1 and has a first end 30 secured on the slide 14 of the main body 1. The first end 30 of the support rod 3 is flattened, and the slide 14 of the main body 1 is formed with a flattened locking recess 141 for mounting the flattened first end 30 of the support rod 3.

Figure 4:
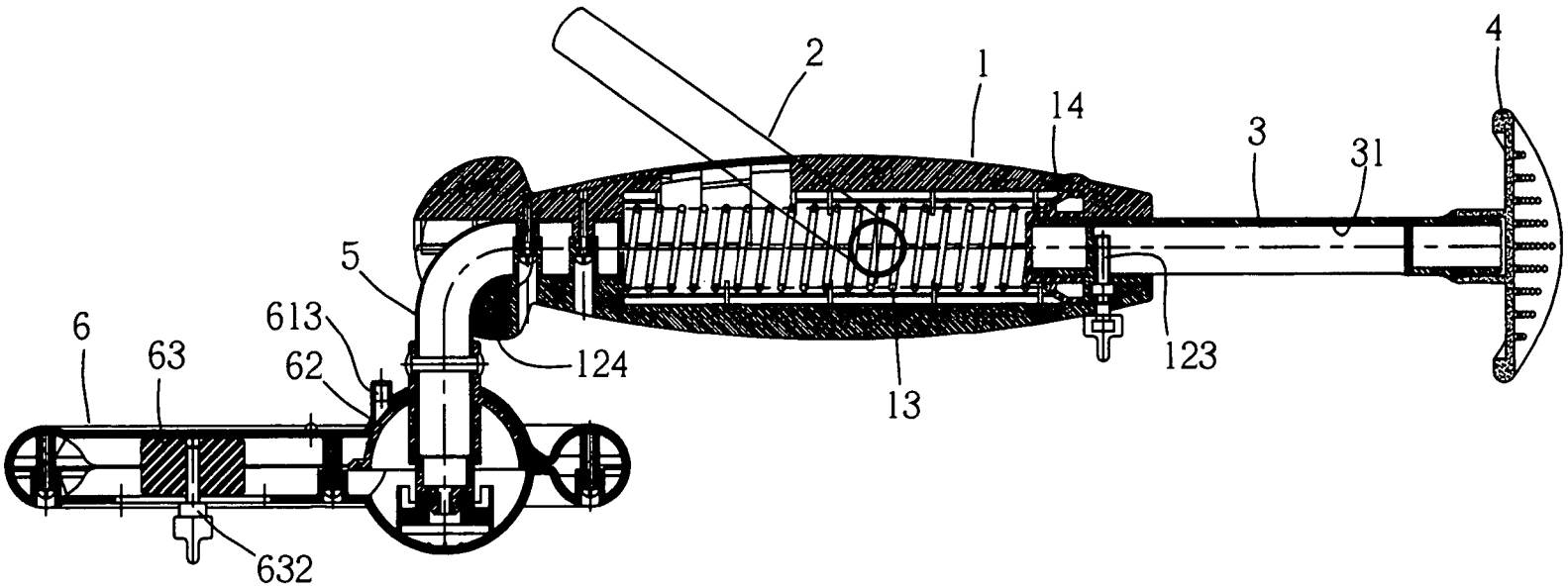
FIG. 4 is a side plan cross-sectional view of the exercising device as shown in FIG. 1.

The support rod 3 has a periphery formed with a limit channel 31 (see FIGS. 4 and 7), and the main body 1 further includes a threaded limit member 123 screwed onto one of the two casings 12 and extended into the limit channel 31 of the support rod 3 to prevent the support rod 3 from being rotated relative to the main body 1. In addition, the limit member 123 prevents the support rod 3 from detaching from the main body 1 as shown in FIG. 4. Alternatively, the limit member 123 is unscrewed from the respective casing 12 to detach from the limit channel 31 of the support rod 3, so that the support rod 3 can be detached from the main body 1 easily and rapidly, there facilitating storage, package and transportation of the exercising device.

The resting board 4 having an arcuate shape is mounted on the support rod 3 and has a side formed with a protruding mounting lug 41 mounted on a second end 32 of the support rod 3. The second end 32 of the support rod 3 is flattened, and the mounting lug 41 of the resting board 4 is formed with a flattened locking recess 411 for mounting the flattened second end 32 of the support rod 3, thereby preventing the resting board 4 from being rotated relative to the support rod 3.

The connecting lever 5 is mounted on the main body 1. The connecting lever 5 is substantially inverted L-shaped and has a first section secured in the second receiving recess 122 of each of the two casings 12.

The rotation body 6 is mounted on the connecting lever 5 and includes a pivot ring 62 secured on a second section of the connecting lever 5, a first disk 61 rotatably mounted on the pivot ring 62, a second disk 64 rotatably mounted on the pivot ring 62 and combined with the first disk 61 so that the pivot ring 62 is located between the first disk 61 and the second disk 64, and a counterweight 63 mounted between the first disk 61 and the second disk 64 to rotate therewith.

The first disk 61 of the rotation body 6 is formed with an eccentrically arranged semi-spherical first protruding portion 611 formed with a mounting hole 612 mounted on the pivot ring 62. A sensing magnet 613 is mounted on the first protruding portion 611 of the first disk 61 and located adjacent to the mounting hole 612. The first disk 61 of the rotation body 6 has an inside formed with a first slideway 614 connected to the first protruding portion 611.

Figure 5:
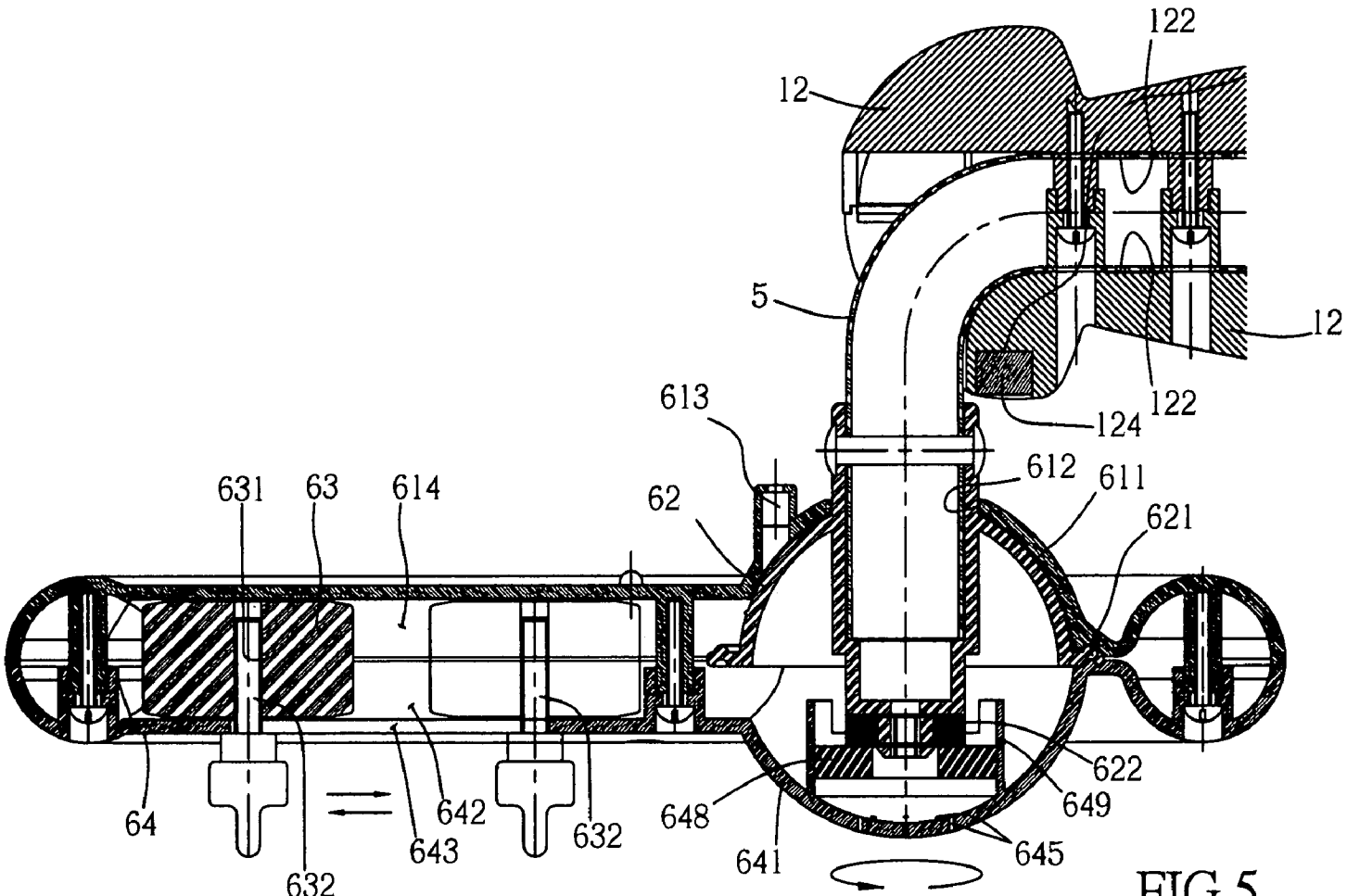
FIG. 5 is a locally enlarged view of the exercising device as shown in FIG. 4.

The pivot ring 62 of the rotation body 6 has a semi-spherical portion rested on the first protruding portion 611 of the first disk 61 and having a periphery formed with an annular flange 621 (see FIG. 5).

The second disk 64 of the rotation body 6 is formed with an eccentrically arranged semi-spherical second protruding portion 641 aligning with the first protruding portion 611 of the first disk 61. The second disk 64 of the rotation body 6 has an inside formed with a second slideway 642 connected to the second protruding portion 641 and communicating with the first slideway 614 of the first disk 61.

The counterweight 63 of the rotation body 6 is movably mounted in the first slideway 614 of the first disk 61 and the second slideway 642 of the second disk 64. The second disk 64 of the rotation body 6 has a surface formed with an elongated guide slot 643 communicating with the second slideway 642, the counterweight 63 of the rotation body 6 is formed with a screw bore 631, and the rotation body 6 further includes a threaded rod 632 slidably mounted in the guide slot 643 of the second disk 64 and screwed into the screw bore 631 of the counterweight 63.

The rotation body 6 further includes a connecting ring 620 (see FIG. 5A) rotatably mounted on the pivot ring 62 and having an inner wall formed with an annular toothed groove 6201 (see FIG. 5A), a generator 622 mounted on a bottom of the connecting ring 620 and having a center provided with a gear 6221 (see FIG. 5A) meshing with and rotated by the toothed groove 6201 of the connecting ring 620, a sound emitter 648 mounted on the second protruding portion 641 of the second disk 64 and connected to the generator 622 by two electric wires 647, and a plurality of light emitting diodes (LED) 646 connected to the sound emitter 648 by the two electric wires 647. Preferably, the second protruding portion 641 of the second disk 64 is formed with a receiving chamber 649 for mounting the sound emitter 648. The receiving chamber 649 has a bottom formed with a plurality of through holes 645.

Figure 7:
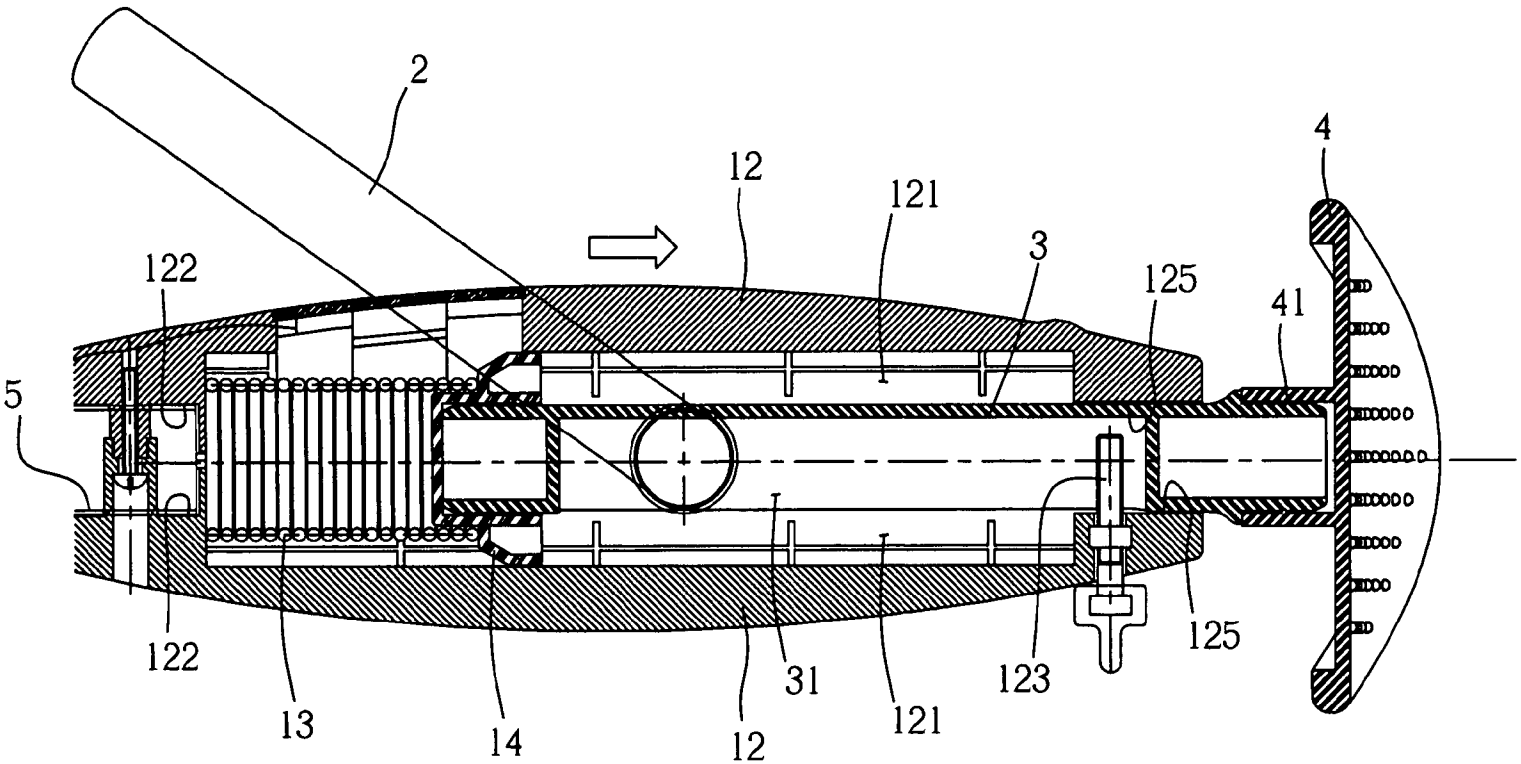
FIG. 7 is a schematic operational view of the exercising device as shown in FIG. 4 in use.

In operation, referring to FIGS. 1–7, the resting board 4 is initially rested on a user's abdomen. Then, the user's two hands hold the two handles 2 to move the main body 1 toward the resting board 4, so that the support rod 3 is moved into the slide channel 121 of the main body 1 to compress the elastic member 13 of the main body 1 as shown in FIG. 7. In such a manner, the user's abdomen applies a force on the resting board 4 to overcome the elastic force of the elastic member 13, thereby achieving the purpose of exercising the user's abdomen. In addition, the user's two hands apply a force on the two handles 2 to overcome the elastic force of the elastic member 13, thereby achieving the purpose of exercising the user's arms.

Alternatively, when the user's two hands hold the two handles 2 to swivel the main body 1, the rotation body 6 is rotated relative to the main body 1 about the connecting lever 5. At this time, the counterweight 63 provides a resistance to rotation of the rotation body 6, thereby achieving the purpose of exercising the user's waist and abdomen.

In addition, as shown in FIG. 5, when the rotation body 6 is rotated relative to the main body 1, the sensing magnet 613 of the rotation body 6 is movable to align with the sensing counter 124 of the main body 1 to produce an intermittent magnetic signal which is transmitted to the electronic counter 113 of the main body 1 to indicate the rotation number of the rotation body 6.

In addition, the counterweight 63 of the rotation body 6 is movable in the first slideway 614 of the first disk 61 and the second slideway 642 of the second disk 64 by unscrewing the threaded rod 632 to adjust the relative position of the counterweight 63 in the rotation body 6 as shown in FIG. 5, so as to adjust the resistance of the counterweight 63 to rotation of the rotation body 6.

Figure 5A:
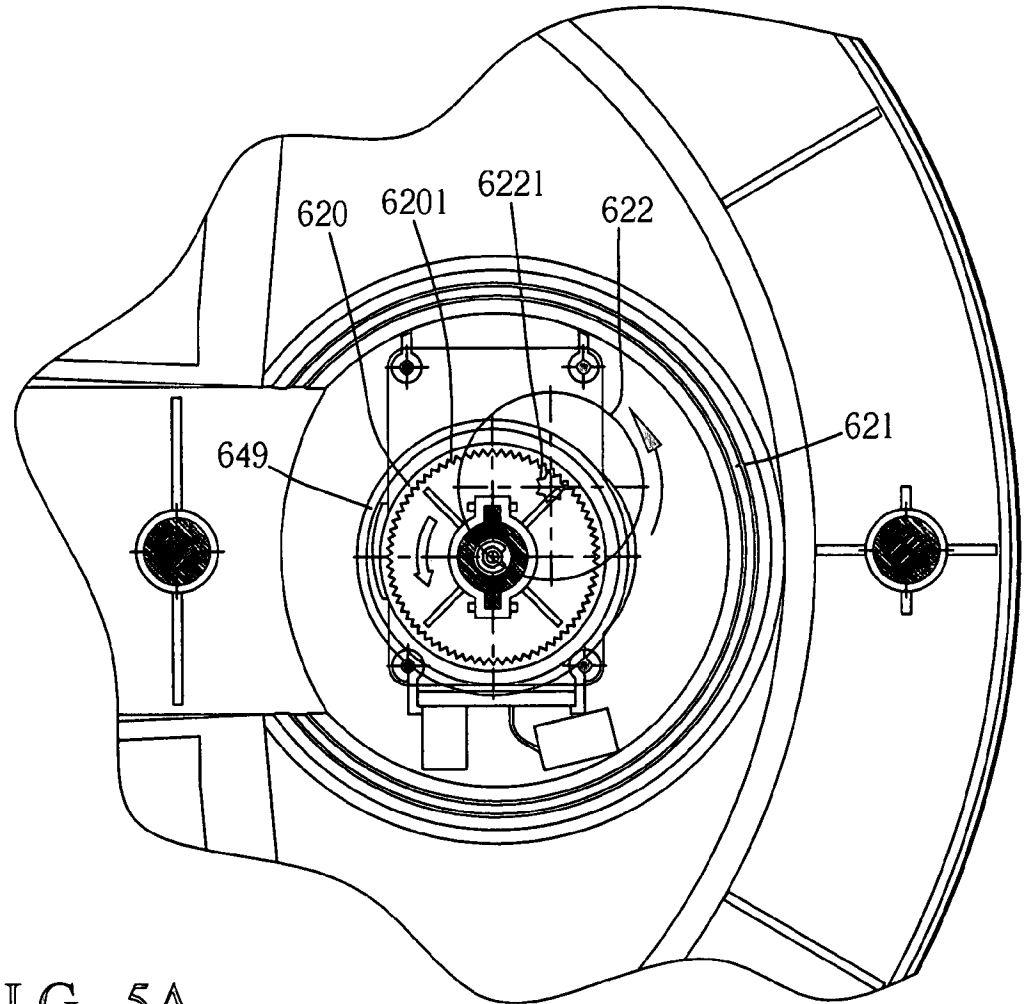
FIG. 5A is a partially cut-away top plan view of the exercising device as shown in FIG. 1.
Figure 6:
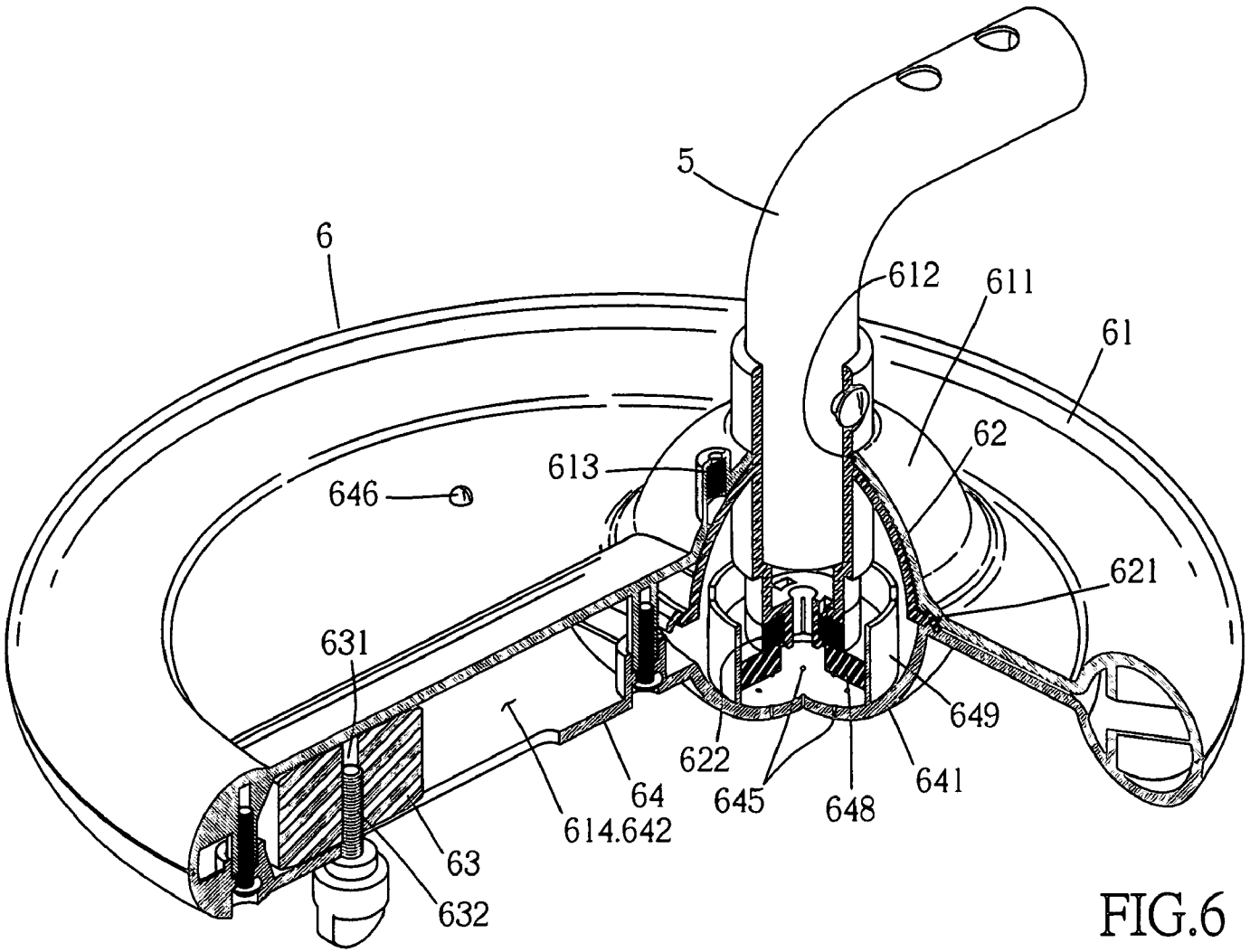
FIG. 6 is a locally enlarged cross-sectional view of the exercising device as shown in FIG. 1.

As shown in FIGS. 5 and 5A, when the rotation body 6 is rotated about the pivot ring 62, the connecting ring 620 is rotated simultaneously to rotate the toothed groove 6201 which drives the gear 6221 of the generator 622 to rotate, so that the generator 622 rotates to produce an electric current which is supplied to the sound emitter 648 to produce sound and to the light emitting diodes 646 to produce light, thereby enhancing the versatility of the exercising device. The sound produced by the sound emitter 648 is emitted outward from the through holes 645 of the receiving chamber 649.

Figure 8:
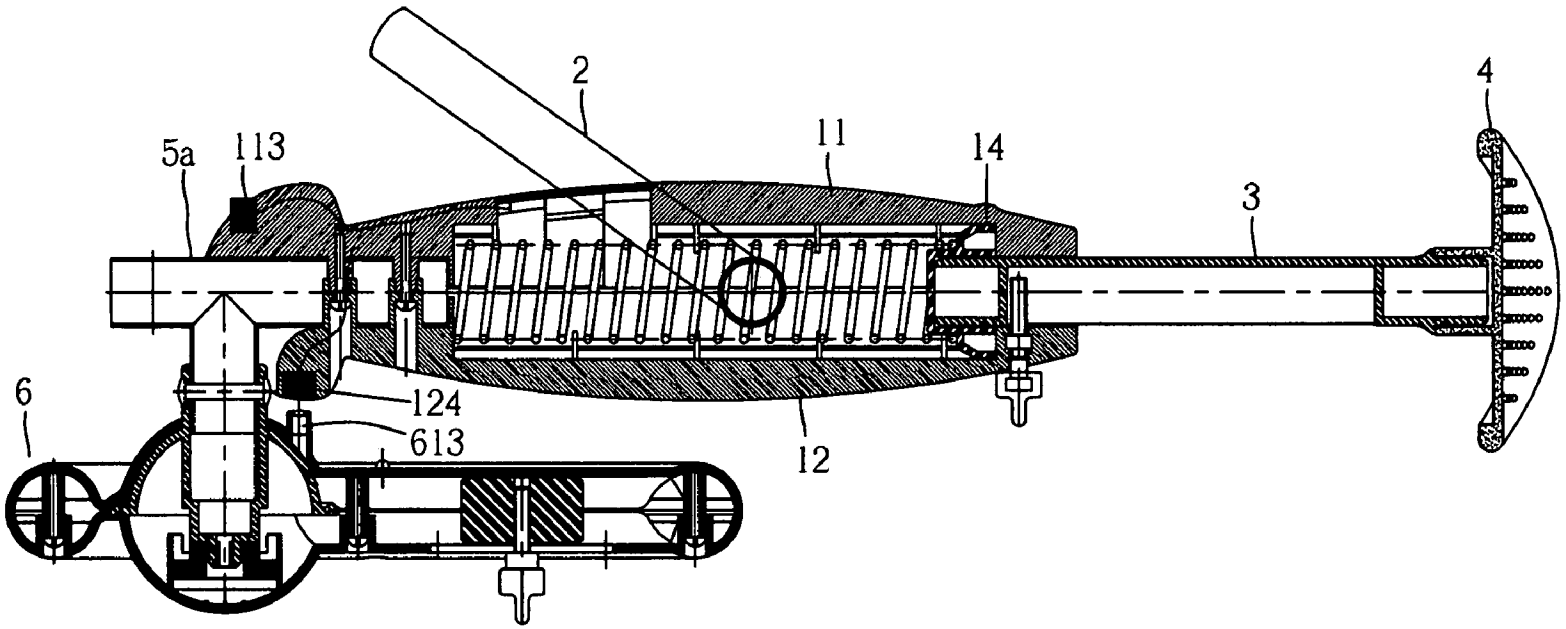
FIG. 8 is a side plan cross-sectional view of an exercising device in accordance with another embodiment of the present invention.
Figure 9:
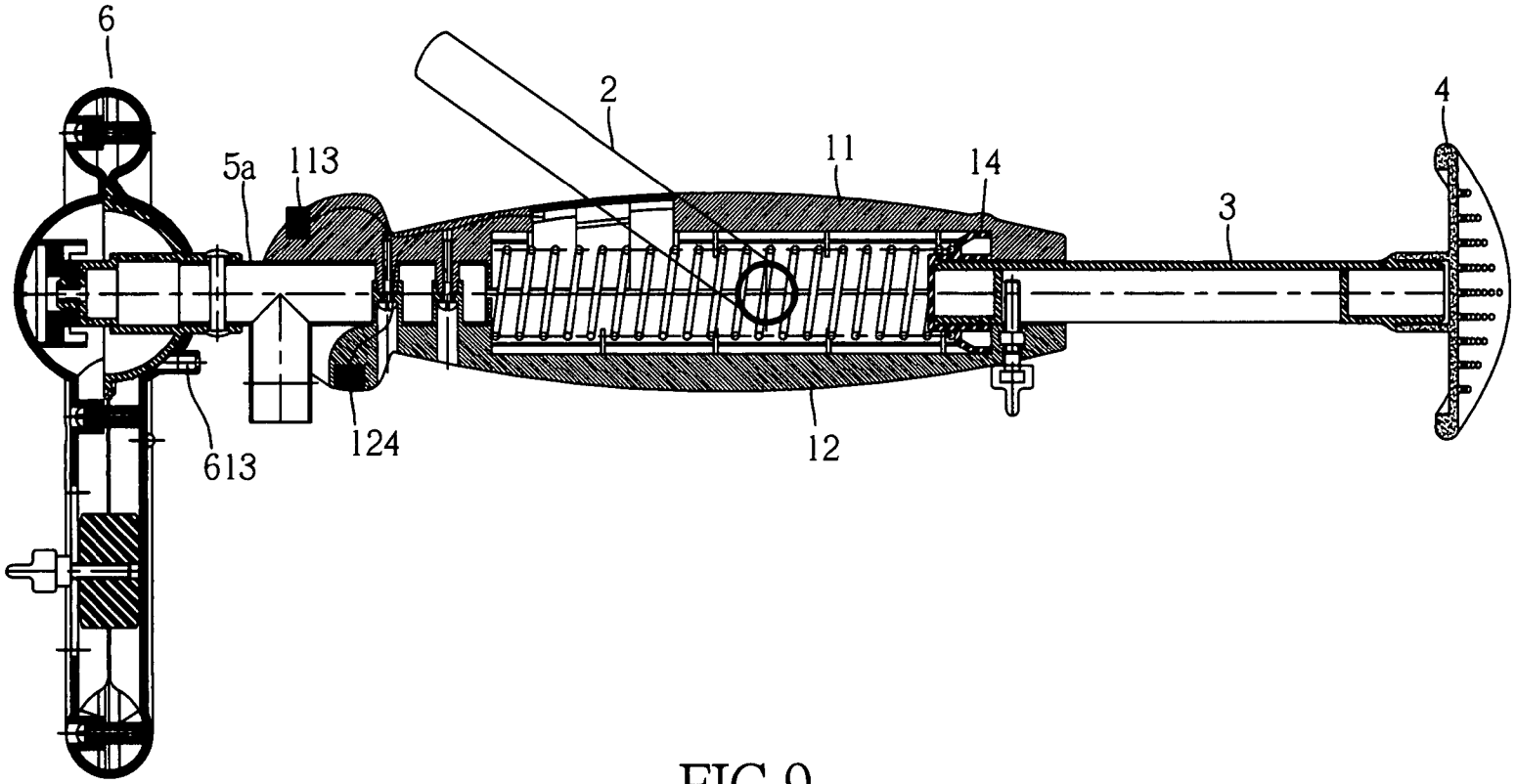
FIG. 9 is a side plan cross-sectional view of the exercising device in accordance with another embodiment of the present invention.

As shown in FIGS. 8 and 9, the connecting lever 5*a* is substantially T-shaped.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. An exercising device, comprising a main body, two handles, a support rod, a resting board, a connecting lever, and a rotation body, wherein:

the main body includes two casings, a slide, and an elastic member;

each of the two casings of the main body has an inside formed with an axially extended slide channel;

the slide of the main body is mounted between the two casings and movably mounted in the slide channel of each of the two casings;

the elastic member of the main body is mounted between the two casings and received in the slide channel of each of the two casings, the elastic member of the main body has a first end urged on the slide and a second end urged on the two casings;

each of the two handles is mounted on the main body;

the support rod is movably mounted in the slide channel of the main body and has a first end secured on the slide of the main body;

the resting board is mounted on the support rod;

the connecting lever is mounted on the main body; and the rotation body includes a pivot ring secured on the connecting lever, a first disk rotatably mounted on the pivot ring, a second disk rotatably mounted on the pivot ring about a pivot axis and combined with the first disk so that the pivot ring is located between the first disk and the second disk, and a counterweight radially adjusted with respect to said pivot axis mounted between the first disk and the second disk to rotate therewith.

2. The exercising device in accordance with claim 1, wherein the first disk of the rotation body is formed with an eccentrically arranged semi-spherical first protruding portion formed with a mounting hole mounted on the pivot ring, the first disk of the rotation body has an inside formed with a first slideway connected to the first protruding portion, the second disk of the rotation body is formed with an eccentrically arranged semi-spherical second protruding portion aligning with the first protruding portion of the first disk, the second disk of the rotation body has an inside formed with a second slideway connected to the second protruding portion and communicating with the first slideway of the first disk, and the counterweight of the rotation body is movably mounted in the first slideway of the first disk and the second slideway of the second disk.

3. The exercising device in accordance with claim 2, wherein the pivot ring of the rotation body has a semi-spherical portion rested on the first protruding portion of the first disk and having a periphery formed with an annular flange.

4. The exercising device in accordance with claim 2, wherein the second disk of the rotation body has a surface formed with an elongated guide slot communicating with the second slideway, the counterweight of the rotation body is formed with a screw bore, and the rotation body further includes a threaded rod slidably mounted in the guide slot of the second disk and screwed into the screw bore of the counterweight.

5. The exercising device in accordance with claim 2, wherein the rotation body further includes a connecting ring rotatably mounted on the pivot ring and having an inner wall formed with an annular toothed groove, and a generator mounted on a bottom of the connecting ring and having a center provided with a gear meshing with and rotated by the toothed groove of the connecting ring.

6. The exercising device in accordance with claim 5, wherein the rotation body further includes a sound emitter mounted on the second protruding portion of the second disk and connected to the generator by two electric wires.

7. The exercising device in accordance with claim 6, wherein the rotation body further includes a plurality of light emitting diodes connected to the sound emitter by the two electric wires.

8. The exercising device in accordance with claim 6, wherein the second protruding portion of the second disk is formed with a receiving chamber for mounting the sound emitter.

9. The exercising device in accordance with claim 8, wherein the receiving chamber has a bottom formed with a plurality of through holes.

10. The exercising device in accordance with claim 1, wherein the main body further includes an electronic counter mounted on one of the two casings and located adjacent to the slide channel, a sensing counter mounted on the other one of the two casings, and the rotation body further includes a sensing magnet mounted on the first disk, and the sensing magnet of the rotation body is movable to align with the sensing counter of the main body to produce an intermittent magnetic signal which is transmitted to the electronic counter of the main body to indicate a rotation number of the rotation body.

11. The exercising device in accordance with claim 1, wherein each of the two casings of the main body has a periphery formed with two opposite mounting recesses, and each of the two handles includes a mounting section locked in a respective one of the two mounting recesses of each of the two casings, and an operation section adjustably mounted on the mounting section by an elastic snapping member.

12. The exercising device in accordance with claim 1, wherein the first end of the support rod is flattened, and the slide of the main body is formed with a flattened locking recess for mounting the flattened first end of the support rod.

13. The exercising device in accordance with claim 1, wherein the support rod has a periphery formed with a limit channel, and the main body further includes a threaded limit member screwed onto one of the two casings and extended into the limit channel of the support rod to prevent the support rod from being rotated relative to the main body.

14. The exercising device in accordance with claim 1, wherein the resting board has a side formed with a protruding mounting lug mounted on a second end of the support rod.

15. The exercising device in accordance with claim 14, wherein the second end of the support rod is flattened, and the mounting lug of the resting board is formed with a flattened locking recess for mounting the flattened second end of the support rod, thereby preventing the resting board from being rotated relative to the support rod.

16. The exercising device in accordance with claim 1, wherein the connecting lever is substantially inverted L-shaped.

17. The exercising device in accordance with claim 1, wherein the connecting lever is substantially T-shaped.

18. The exercising device in accordance with claim 1, wherein the slide channel of each of the two casings has a first end formed with a first receiving recess and a second end formed with a second receiving recess, the connecting lever has a first section secured in the second receiving recess of each of the two casings, and the pivot ring of the rotation body is secured on a second section of the connecting lever.

19. The exercising device in accordance with claim 1, wherein the two casings of the main body are combined with each other.

20. The exercising device in accordance with claim 1, wherein the resting board has an arcuate shape.

* * * * *